US008276513B2

(12) United States Patent
McGaire

(10) Patent No.: US 8,276,513 B2
(45) Date of Patent: Oct. 2, 2012

(54) METHOD FOR HANDLING PRINTING PLATES AND ADJUSTING THE SPACING BETWEEN PLATES

(75) Inventor: Mark D. McGaire, Surrey (CA)

(73) Assignee: Eastman Kodak Company, Rochester, NY (US)

( * ) Notice: Subject to any disclaimer, the term of this patent is extended or adjusted under 35 U.S.C. 154(b) by 1105 days.

(21) Appl. No.: 12/177,899

(22) Filed: Jul. 23, 2008

(65) Prior Publication Data

US 2010/0018422 A1 Jan. 28, 2010

(51) Int. Cl.
*B41F 27/00* (2006.01)

(52) U.S. Cl. ..... 101/485; 101/477; 101/401.1

(58) Field of Classification Search ..... 101/477, 101/401.1, 485, 486, 483
See application file for complete search history.

(56) References Cited

U.S. PATENT DOCUMENTS 5,964,044 A 10/1999 Lauersdorf et al.
6,323,462 B1 11/2001 Strand
6,354,208 B1 3/2002 Bos et al.
6,948,430 B1 * 9/2005 Montbleau et al. ..... 101/477

FOREIGN PATENT DOCUMENTS

WO WO 2007/117477 10/2007

* cited by examiner

*Primary Examiner* — Leslie J Evanisko
(74) *Attorney, Agent, or Firm* — Nelson Adrian Blish

(57) ABSTRACT

A method for ejecting printing plates from an imaging apparatus includes providing a plurality of the printing plates to the imaging apparatus; forming an image on at least one of the printing plates; determining a desired tail-to-tip spacing between adjacent printing plates; ejecting a sequence of the printing plates from the imaging apparatus along a path; and adjusting a spacing between two adjacent printing plates in the sequence of the printing plates to reduce a variance between a projected tail-to-tip spacing and the desired tail-to-tip spacing.

24 Claims, 13 Drawing Sheets

METHOD FOR HANDLING PRINTING PLATES AND ADJUSTING THE SPACING BETWEEN PLATES

CROSS REFERENCE TO RELATED APPLICATIONS

Reference is made to commonly-assigned U.S. patent application Ser. No. 12/177,901 (now U.S. Publication No. 2010/0018423), filed Jul. 23, 2008, entitled PRINTING PLATE TRANSFERRING SYSTEM, by Mark McGaire, the disclosure of which is incorporated herein.

FIELD OF THE INVENTION

The invention relates to a sequence of printing plates subjected to various processing steps, and particularly to the adjustment of a spacing between two printing plates in a sequence of printing plates that are processed in a plurality of systems within a processing line.

BACKGROUND OF THE INVENTION

Contact printing using high volume presses is commonly employed to print a large number of copies of an image. Contact printing presses utilize printing plates to apply colorants to a surface to form an image thereon. The surface can form part of a receiver medium (e.g. paper) or can form part of an intermediate component adapted to transfer the colorant from its surface to the receiver medium (e.g. a blanket cylinder of a press). In either case, a colorant pattern is transferred to the receiver medium to form an image on the receiver medium.

Printing plates typically undergo various processes to render them in a suitable configuration for use in a printing press. For example, exposure processes are used to form images on an imageable surface of a printing plate that has been suitably treated so as to be sensitive to light or heat radiation. One type of exposure process employs film masks. The masks are typically formed by exposing highly sensitive film media using a laser printer known as an "image-setter." The film media can be additionally developed to form the mask. The film mask is then placed in area contact with a sensitized printing plate, which is in turn exposed through the mask. Printing plates exposed in this manner are typically referred to as "conventional printing plates." Typical conventional lithographic printing plates are sensitive to radiation in the ultraviolet region of the light spectrum.

Another conventional method exposes printing plates directly through the use of a specialized imaging apparatus typically referred to as a plate-setter. A plate-setter, in combination with a controller that receives and conditions image data for use by the plate-setter, is commonly known as a "computer-to-plate" or "CTP" system. CTP systems offer a substantial advantage over image-setters in that they eliminate film masks and associated process variations associated therewith. Printing plates imaged by CTP systems are typically referred to as "digital" printing plates. Digital printing plates can include photopolymer coatings (i.e. visible light plates) or thermo-sensitive coatings (i.e. thermal plates).

Many types of printing plates also undergo additional processing steps which can include chemical development. For example, chemical development steps are additionally required to amplify a difference between exposed and unexposed areas. Other processing steps can include pre-heating and/or post heating steps. Once exposed or imaged, some printing plates undergo a pre-heating process so as to change the solubility of various regions of the printing plate in a subsequent chemical development process to achieve the desired differentiation between printable and non-printable areas. Post-baking of a chemically developed printing plate can be conducted to impart various desired characteristics to the printing plate. Such characteristics can include increased plate life. Gumming processes can also be performed to protect various surfaces of the printing plate from adverse environmental conditions. Further processing steps can include punching and bending procedures which can be used to impart various features on the printing plates to facilitate the mounting and registration of the printing plates on press. In some cases, some CTP systems include on-board punching capabilities.

The various processing steps are typically conducted within a processing line made up of various systems. FIGS. 1A, 1B, and 1C each show a schematic plan and side views illustrating example conventional processing lines 102A, 102B, and 102C. Processing lines 102A, 102B, and 102C are each examples of typical processing lines that can be used to process various printing plates 24 ejected from an imaging apparatus 100 such as a CTP system. The choice of a particular processing line configuration can be dependant on various factors which can include the type of printing plates 24 to be imaged, the space available to accommodate the processing line and a desire to marry a particular printing plate 24 with a particular system within the processing line. Such a marriage may arise when a vendor bundles both the printing plates 24 and various processing line systems to create an economic opportunity that is beneficial for the customer.

Each of the processing lines 102A, 102B, and 102C include various systems. Various apparatus can be employed to guide the printing plates 24 through various process paths to, or among the various systems of a given processing line. Apparatus which can include various conveyors (e.g. belt, roller, or chain conveyors), gantries and the like can be used to transport the printing plates 24 between the various systems and present the plates at a given system with a positioning suitable for the particular processing associated with that system. In some cases, the apparatus are part of a processing line system.

Processing lines 102A and 102B each include various systems that include a pre-bake oven 110, a chemical developer 112, and a post-bake oven 114. Processing line 102C includes a chemical developer 116 and post-bake oven 114. Each of the processing lines 102A, 102B, and 102C terminates with a plate stacker system 115. It is understood that each of the processing lines are exemplary in nature and other processing lines can use other combinations or types of systems.

The configuration of the each of the systems can dictate how each of the printing plates 24 is processed within the systems as well as the overall throughput of the processing line. In these illustrated cases, each of these systems processes the printing plates 24 as the plates are moved through them. Accordingly, suitable processing of the printing plates 24 is typically dependant on a rate of movement of the printing plates 24 through a system of the processing line. In some cases, a rate of movement of a printing plate 24 through a first system may be adjusted according to a rate of movement of the printing plate 24 required by an additional system.

Other aspects of the particular configuration of a particular system can impact the overall throughput of an associated processing line. Typically, most pre-bake ovens are conveyor ovens. Examples of conveyor ovens adapted to heat printing plates are described in U.S. Pat. No. 5,964,044 (Lauerdorf et al.) and in U.S. Pat. No. 6,323,462 (Strand). In this regard, pre-bake oven 110 comprises a movable support 120 adapted to transport a printing plate 24 through the oven with a desired rate of movement. Needless to say, movable support 120 must be suitably constructed to withstand the oven temperatures. In various pre-bake ovens, movable support 120 typically takes the form of a conveyor that includes an endless loop of a meshed material 122 that is driven by various sprockets 124. Meshed material 122 is selected to withstand the oven temperatures and can include metals such a steel or stainless steel, for example.

The meshed movable support 120 can be used to better support the printing plate as it is transported through pre-bake oven 110. Problems can however arise with this configuration of pre-bake oven 110. For example, when pre-bake oven 110 is the first processing system in its associated processing line, care must be taken as printing plates 24 are transferred from imaging apparatus 100 to pre-bake oven 110. A printing plate 24 should not be ejected from imaging apparatus 100 with a rate of movement that is substantially greater than that of meshed movable support 120. To do so would increase a probability that an edge portion or corner portion of the printing plate 24 would be caught in the mesh and result in damage to the printing plate 24. Accordingly, it is typically desired that printing plates 24 be ejected from imaging apparatus 100 with a rate of movement that is substantially similar to the rate of movement of the meshed moveable support 120.

Some processing lines attempt to reduce similar potential damage to printing plates by introducing a buffering system. For example, processing line 102B includes a buffering system 118 in a location between imaging apparatus 100 and pre-bake oven 110. In this conventional processing line, buffering system 118 also includes a moveable support 126 which is adapted to transport a printing plate 24 ejected from imaging apparatus 100 towards pre-bake oven 110. In this case, movable support 126 forms part of a conveyor and includes a plurality of belts 127 that are driven by plurality of drive pulleys 128. Since movable support 126 is separated from the heated components of pre-bake oven 110, belts 127 need not be constrained to incorporate various heat resistant materials that are typically employed in conveyor oven applications. Belts 127 can include suitable elastomeric, plastic or metal compositions for example. Typically, belts 127 have frictional characteristics suitable for engaging a surface of a printing plate 24 to transport the printing plate. These frictional characteristics can also be tempered to allow relative movement, or slip to occur between the belts 127 and a printing plate 24 as the plate is ejected from the imaging apparatus 100 onto the belts 127. For example, belts 127 can be driven at a speed that is substantially the same as that of the meshed movable support 120 of pre-bake oven 110 to reduce the potential damage to a printing plate 24 transferred between the two systems. The printing plate 24 can, however, be ejected from imaging apparatus 100 at a much faster speed than that of belts 127 since their construction allows for slippage as the moving printing plate 24 is ejected onto the moving belts 127. This processing line configuration allows increased throughput conditions but at a cost of additional space requirements needed to accommodate buffering system 118. The belted configuration of movable support 126 reduces the likelihood of damaging a printing plate ejected thereon even at increased speeds. Other buffering systems can use other forms of movable supports including supports made up of a series of driven rollers.

Processing line 102C does not include a pre-bake oven. Rather printing plates 24 are directly transferred from imaging apparatus 100 to chemical developer 116. Chemical developer 116 includes various moveable members adapted to receive a printing plate 24 ejected from imaging apparatus 100 and transport the printing plate within chemical developer 116. In this case, chemical developer includes a support roller 129A and a nip roller 129B. Both support roller 129A and nip roller 129B are adapted to move in a rotational manner. At least one of support roller 129A and nip roller 129B can be driven members. In this processing line configuration, a printing plate 24 is typically introduced into support roller 129A and nip roller 129B with a speed that does not substantially exceed the speed with which the rollers transport the printing plate within chemical developer 116. Increased ejection speeds could cause buckling in the printing plate 24.

It now becomes apparent to those skilled in the art that the final throughput of the entire plate making process can vary according to the configuration of a particular processing line employed to process the printing plates 24. The processing speed of a processing line is typically dependent on the particular configuration of a system within the processing line.

Conventional CTP systems have employed various printing plate ejection systems. Some conventional CTP ejection systems eject a sequence of printing plates 24 according to a fixed minimum ejection time parameter. For example, one conventional method involves operating an ejector to engage a surface of a first printing plate 24 and move the printing plate 24 to eject it from the CTP system. Each of the printing plates 24 is ejected with a common speed that substantially matches a speed of a processing line that is fed by the CTP system. A printing plate 24 is continuously engaged by the ejector until the ejector reaches an end-of-travel position that is a common position for the ejection of each of the printing plates 24. If a next printing plate 24 is ready to be ejected, the conventional ejection method waits until a set amount of time related to the fixed minimum ejection time parameter had elapsed and then starts ejecting the next printing plate 24 with the common ejection speed. If the ejection readiness of the next printing plate 24 exceeds a time related to the fixed minimum ejection time parameter, then the next printing plate 24 is ejected when ready without waiting, but still with the common ejection speed. This ejection speed does not allow the next printing plate 24 to catch up to the previously ejected printing plate 24, thereby adversely impacting the throughput.

Even if the next printing plate 24 is ready to be ejected, variances in the spacing between these conventionally ejected printing plates 24 can arise. Each printing plate 24 is ejected by operating the ejector to engage a surface of the printing plate 24 prior to moving the plate. The surfaces of the printing plates 24 engaged by these conventional ejection systems correspond to common regions of each of the printing plates 24. For example, the engaged surfaces can be common edge surfaces such as common trailing edge surface or common leading edge surfaces of the printing plates 24 (i.e. as referenced with a direction of movement of the ejection path the printing plates 24 are moved along). The surfaces can be engaged at a common distance from a common reference of each printing plate 24 (i.e. a common leading or trailing edge). FIG. 2 shows sequence of printing plates 24 ejected by this conventional ejection method. In this case each of the printing plates 24 are ejected along a path 135 by causing the ejection system (not shown) to engage a printing plate trailing edge 130 (i.e. also known as the "tail") during the ejection process. When each of the printing plates 24 is available for ejection, the conventional use of the minimum ejection time parameter results in a common tail-to-tail positioning between each adjacent printing plates 24 in the sequence of ejected printing plates. However, since each of the printing plates 24 can include a different size at least along a direction of ejection path 135, a spacing between the tail of each printing plate 24 and the leading edge 132 of printing plate (i.e. also known as the "tip") of an adjacent printing plate 24 causes variable tail-to-tip spacing between various printing plates 24 in the sequence. Variable tail-to-tip spacing can deviate from a desired tail-to-tip spacing required by a particular processing line and thereby adversely impact the throughput of the processing line.

In view of the limitations in the prior art there is a need for an imaging apparatus with improved plate handling capabilities. There is also a need for an imaging apparatus adapted to improve the transfer of printing plates between various supports.

SUMMARY OF THE INVENTION

Briefly, according to one aspect of the present invention a method for ejecting printing plates from an imaging apparatus includes providing a plurality of the printing plates to the imaging apparatus; forming an image on at least one of the printing plates; determining a desired tail-to-tip spacing between adjacent printing plates; ejecting a sequence of the printing plates from the imaging apparatus along a path; and adjusting a spacing between two adjacent printing plates in the sequence of the printing plates to reduce a variance between a projected tail-to-tip spacing and the desired tail-to-tip spacing.

The invention and its objects and advantages will become more apparent in the detailed description of the preferred embodiment presented below.

BRIEF DESCRIPTION OF THE DRAWINGS

Embodiments and applications of the invention are illustrated by the attached non-limiting drawings. The attached drawings are for purposes of illustrating the concepts of the invention and may not be to scale.

DETAILED DESCRIPTION OF THE INVENTION

Figure 1A:
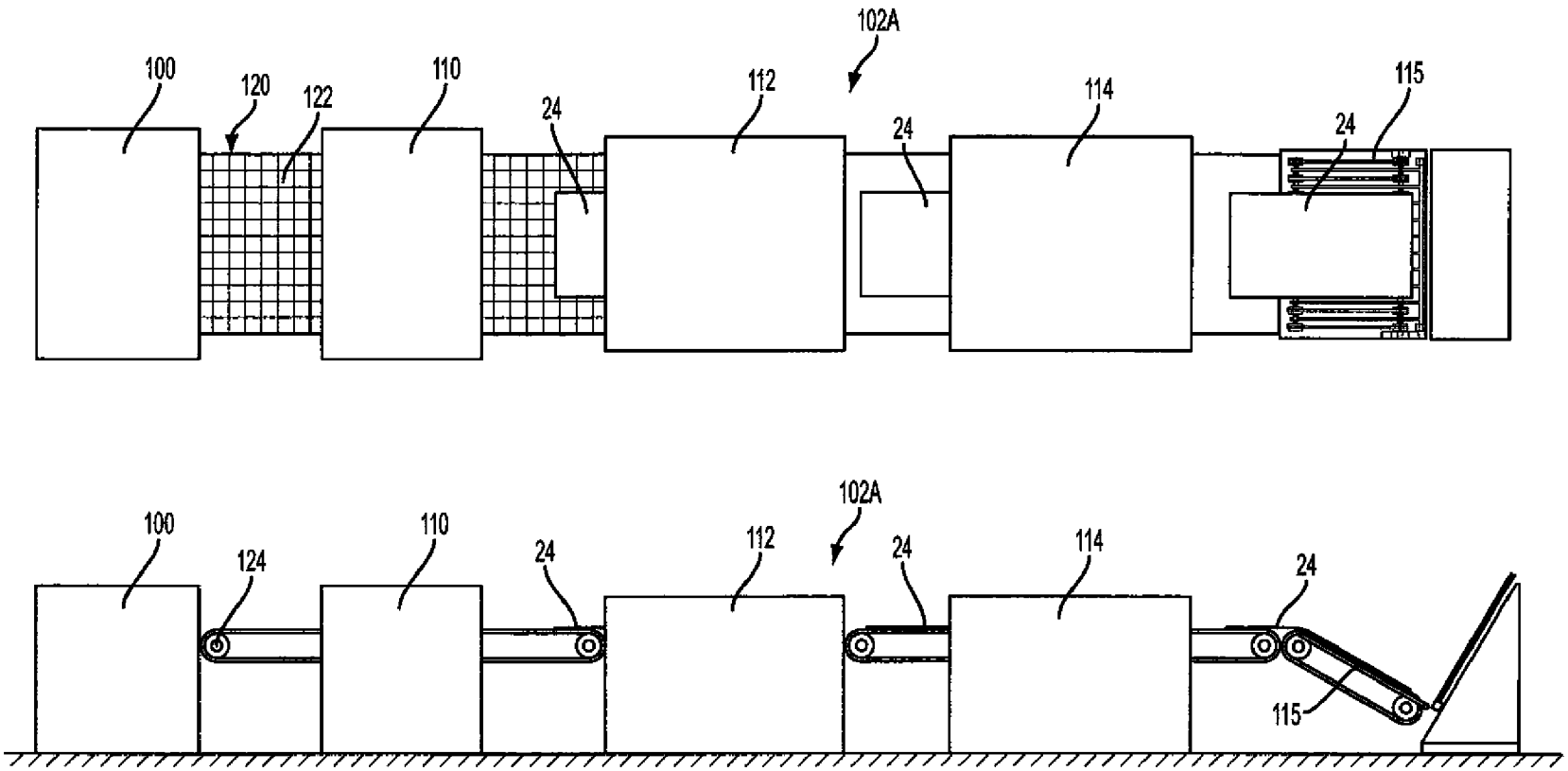
FIG. 1A (PRIOR ART)
FIG. 1A shows a prior art schematic plan and side views of a conventional plate processing line.
Figure 1B:
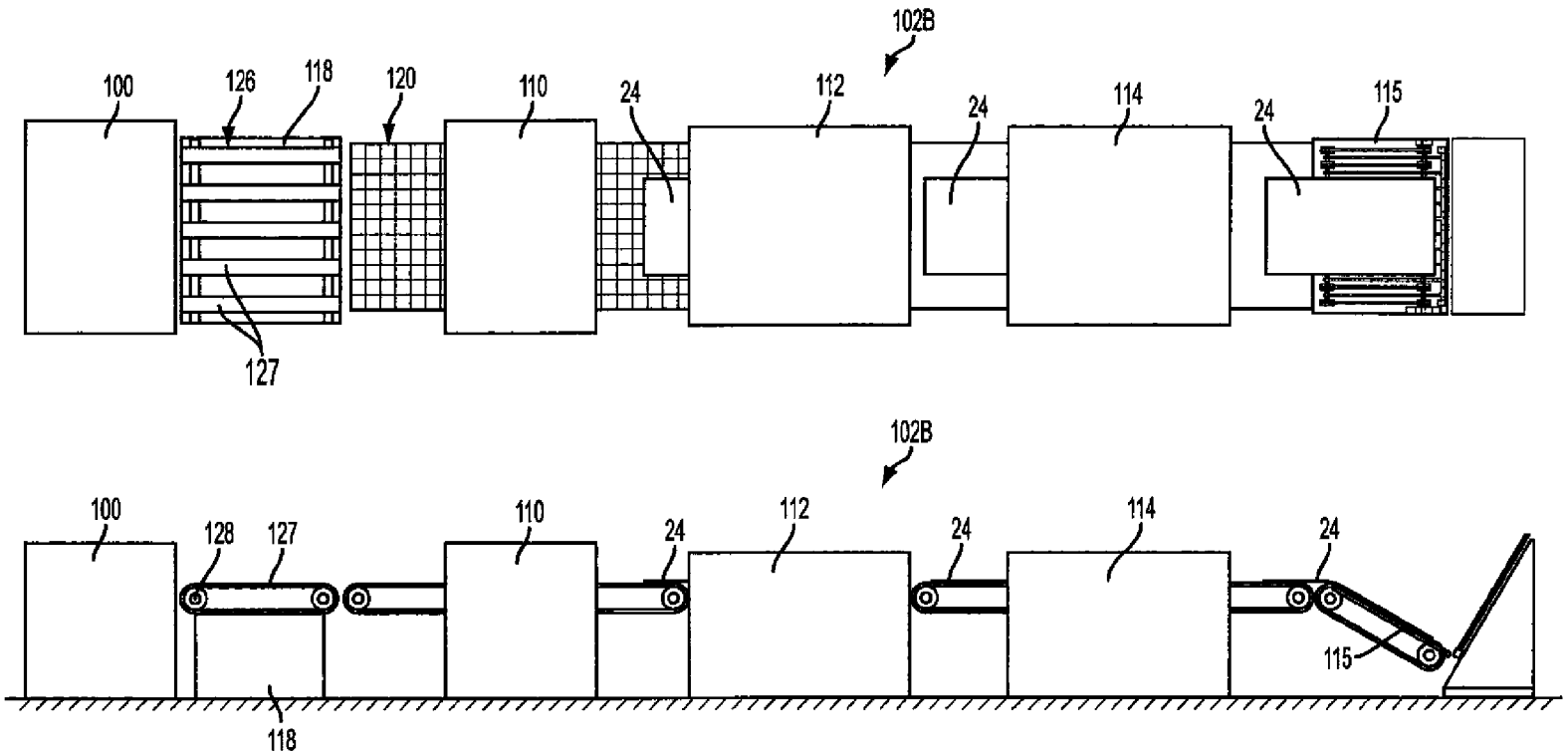
FIG. 1B (PRIOR ART)
FIG. 1B shows a prior art schematic plan and side views of another conventional plate processing line.
Figure 1C:
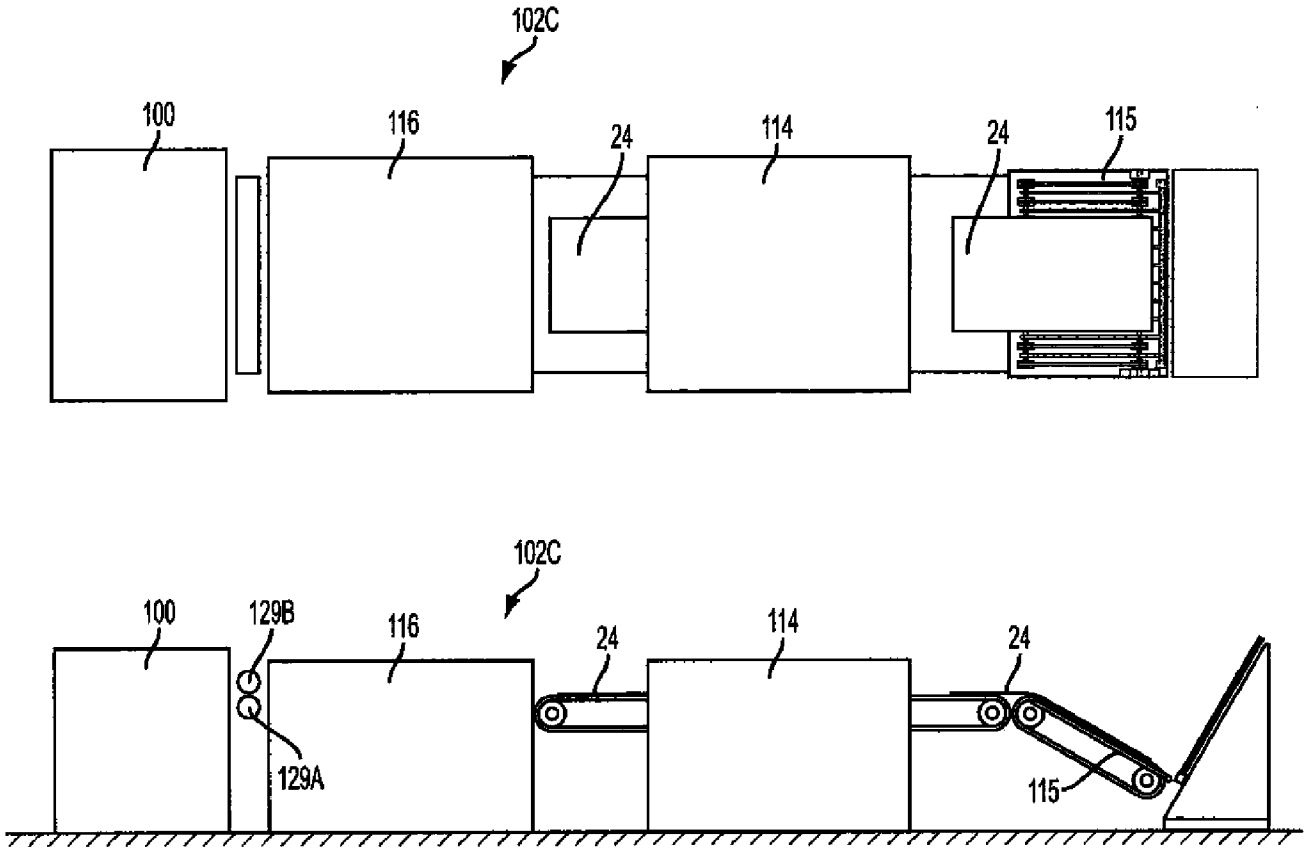
FIG. 1C (PRIOR ART)
FIG. 1C shows a prior art schematic plan and side views of yet another conventional plate processing line.
Figure 2:
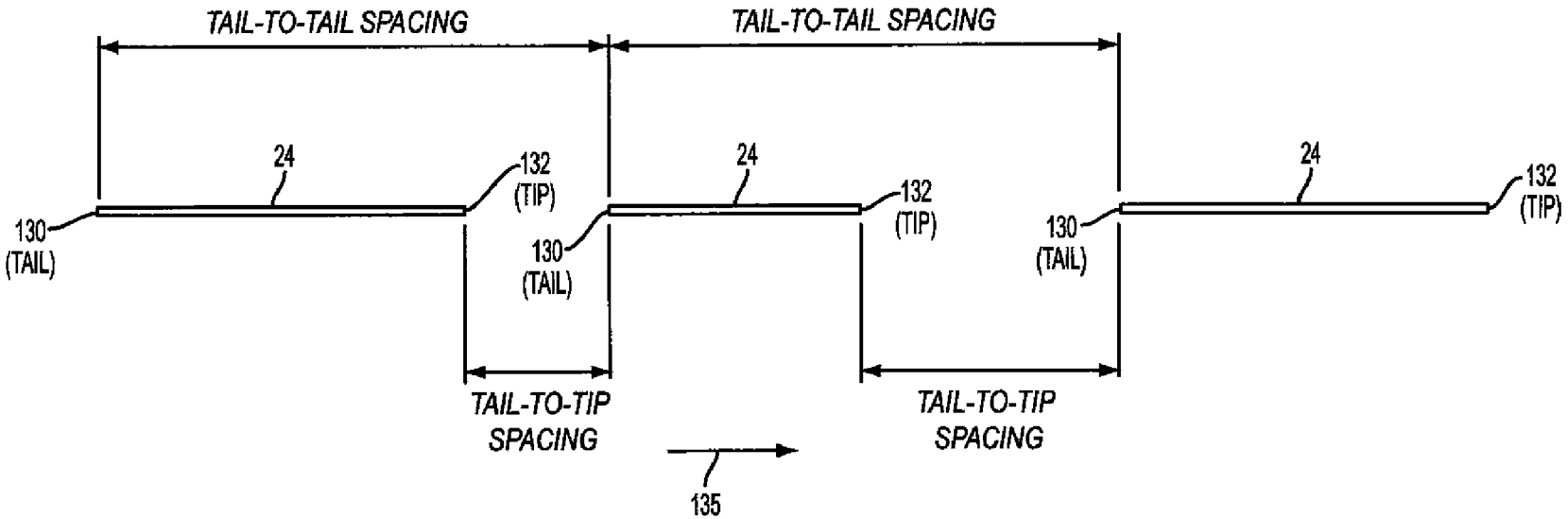
FIG. 2 (PRIOR ART)
FIG. 2 shows a prior art sequence of printing plates 24 ejected by a conventional ejection method.
Figure 3:
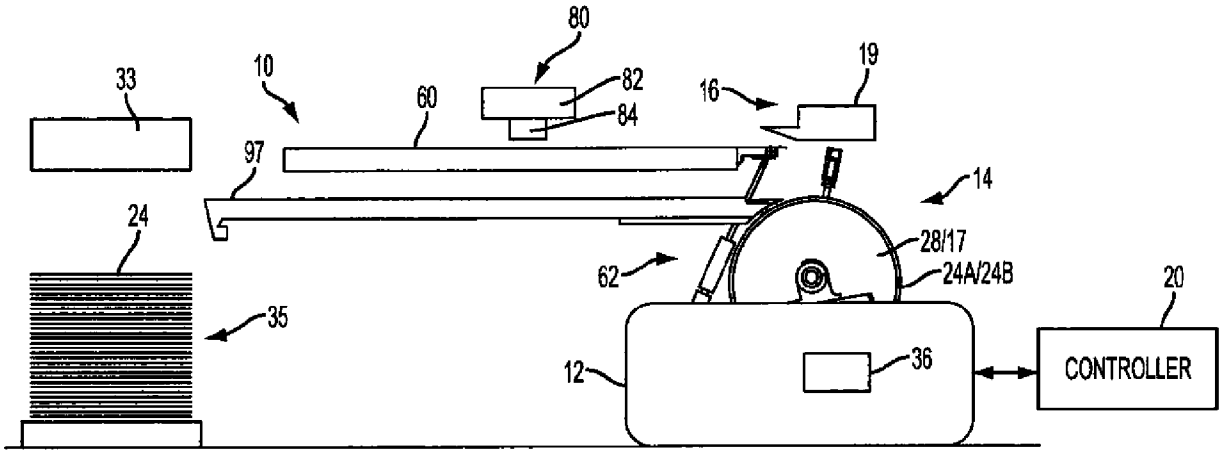
FIG. 3 shows an imaging apparatus according to an example embodiment of the invention.

Throughout the following description specific details are presented to provide a more thorough understanding to persons skilled in the art. However, well-known elements may not have been shown or described in detail to avoid unnecessarily obscuring the disclosure. Accordingly, the description and drawings are to be regarded in an illustrative, rather than a restrictive sense.

FIGS. 3-6 schematically illustrate a printing plate imaging apparatus 10 as per an example embodiment of the invention. In the embodiment of FIGS. 3-6, printing plate imaging apparatus 10 comprises a frame 12 supporting an image recording system 14, a transfer assembly 16, a plate exchange surface 17, an alignment surface punch system 19, and a controller 20.

Controller 20 can comprise a microprocessor such as a programmable general purpose microprocessor, a dedicated micro-processor or micro-controller, or any other system that can receive signals from various sensors, and from external and internal data sources and that can generate control signals to cause actuators and motors within printing plate imaging apparatus 10 to operate in a controlled manner to form imaged printing plates 24.

Image recording system 14 comprises an imaging head 22 adapted to take image-forming actions within an image forming area of an imaging support surface 28 so that an image can be formed on each of one or more printing plates 24 loaded within the image forming area on imaging support surface 28. In the embodiment illustrated, the plurality of printing plates 24 loaded on imaging support surface 28 comprises a first printing plate 24A and a second printing plate 24B. However, this is not limiting and in other embodiments imaging support surface 28 may be capable of holding a different number of printing plates 24 in a manner that allows imaging head 22 to form images on each of printing plates 24 held thereby. First and second printing plates 24A and 24B can include substantially the same size or different sizes as shown in the illustrated embodiment.

Imaging head 22 generates one or more modulated light beams or channels that apply image modulated energy onto first and second printing plates 24A and 24B. Imaging head 22 can move along a sub-scanning axis SSA while a motor 36 or other actuator moves the imaging support surface 28 along a main scanning axis MSA such that image forming actions can be taken over an image forming area of imaging support surface 28 in which first and second printing plates 24A and 24B are located.

Imaging head 22 is illustrated as providing two light emission channel sources 30 and 32 which can each comprise for example a source of laser light and laser modulation systems of a kind known to those of skill in the art (not illustrated) each capable of taking image forming actions on printing plates 24 located within the image forming area. In some embodiments, light emission channel sources 30 and 32 can be independently controlled, each source applying modulated energy to first and second printing plates 24A and 24B. In yet other embodiments of this type, a single light emission channel source can be used to generate a modulated light beam that can be directed across the entire image forming area.

In various embodiments, not illustrated, various types of imaging technology can be used in imaging head 22 to form an image pattern on first and second printing plates 24A and 24B. For example and without limitation, thermal printing plate image forming techniques known to those of skill in the art can be used. The choice of a suitable light emission source can be motivated by the type of printing plate 24 that is to be imaged.

In the embodiment of FIGS. 3-6, imaging support surface 28 illustrates an external drum type of imaging surface having a generally cylindrical exterior surface 34. Accordingly in the embodiment of FIGS. 3 and 4, main scanning axis MSA is illustrated as extending along an axis that is parallel to a direction of rotation of exterior surface 34. However, in other embodiments, imaging support surface 28 can comprise an internal drum or a flatbed. In the external drum embodiment illustrated, first and second printing plates 24A and 24B are held on exterior surface 34 by clamping forces, electrostatic attraction, vacuum force, or other attractive forces supplied respectively by plate clamps, electrostatic systems, vacuum systems, or other plate attracting systems (not illustrated).

During imaging operations, controller 20 causes image modulated beams of light from imaging head 22 to be scanned over the imaging forming area by a combination of operating a main scanning motor 36 to rotate imaging support surface 28 along main scanning axis MSA and translating imaging head 22 in the sub-scanning direction by causing rotation of a threaded screw 38 to which light emission channel sources 30 and 32 are attached in a manner that causes them to advance in a linear fashion down the length of threaded screw 38 as threaded screw 38 is rotated. In some embodiments, light emission channel sources 30 and 32 can be controlled to move independently of one another along sub-scanning axis SSA. Other mechanical translation systems known to those of skill in the art can be used for this purpose. Alternatively, other well-known light beam scanning systems, such as those that employ rotating mirrors, can be used to scan image modulated light across the image forming area of imaging support surface 28.

Figure 4:
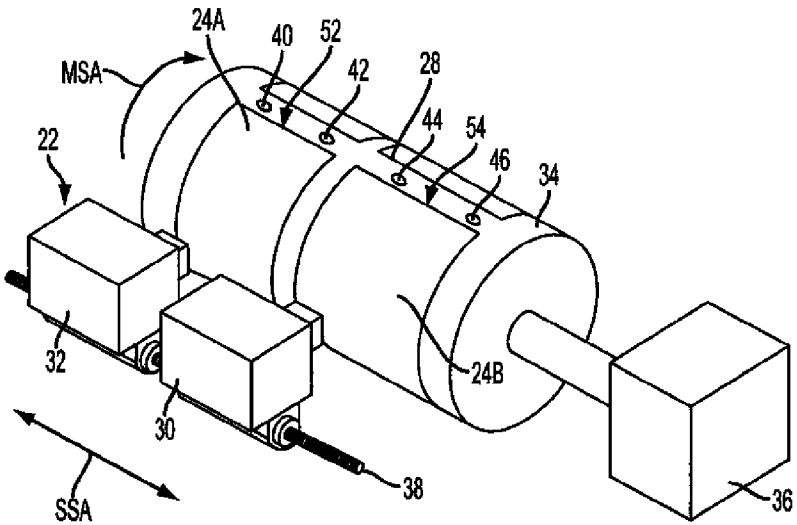
FIG. 4 shows a perspective view of an imaging head and imaging support surface of a type useful with the imaging apparatus of FIG. 3.
Figure 5:
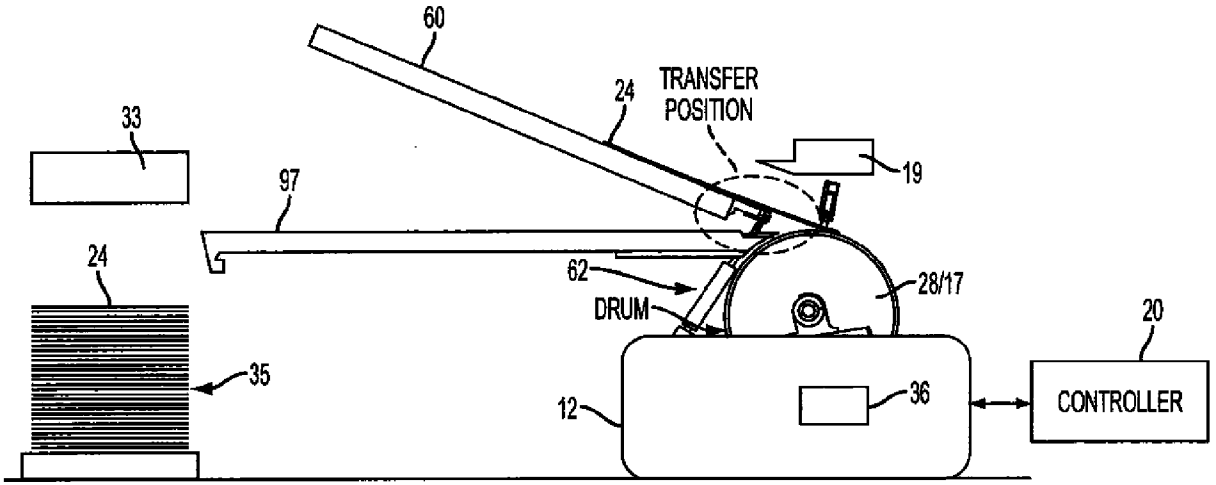
FIG. 5 shows a side view of the imaging apparatus of FIG. 3 with transport support surface in a transfer position.

As is shown in greater detail in FIG. 4, exterior surface 34 has imaging alignment surfaces including first imaging alignment surfaces 40 and 42 and second imaging alignment surfaces 44 and 46 that are associated, respectively, with first and second printing plates 24A and 24B and against which each associated printing plate can be positioned during said imaging operation to locate first and second printing plates 24A and 24B along main scanning axis MSA.

In the embodiment illustrated, a load table 97 is provided and is adapted to exchange first and second printing plates 24A and 24B with imaging support surface 28. First and second printing plates 24A and 24B can be provided to load table 97 for subsequent transfer to imaging support surface 28 in various ways. For example, plate handling mechanism 33 can be used to pick first and second printing plates 24A and 24B from one or more printing plate stacks 35 and transfer the printing plates to load table 97 by various methods are well known in the art. Printing plate stacks 35 can be arranged or grouped in various manners, including by plate size, type, etc. Cassettes, pallets, and other containing members are regularly employed to group a plurality of printing plates. The printing plates 24 in printing plate stack 35 are shown separated from one another for clarity.

Printing plate imaging apparatus 10 has a transfer assembly 16 with a transfer support surface 60 and a positioning system 62. Transfer support surface 60 is sized to receive, hold and/or deliver the plurality of printing plates 24 at the same time. In this example embodiment, positioning system 62 is connected between frame 12 and transfer support surface 60 and defines a movement path for transfer support surface 60 between a transfer position shown in FIG. 5 and a second position shown in FIG. 6. In this illustrated embodiment, transferred printing plates 24 can be punched at the second position.

When transfer support surface 60 is in the transfer position, the plurality of printing plates (e.g. first and second printing plates 24A and 24B) can be transferred between imaging support surface 28 and transfer support surface 60. Depending on the desired flow of printing plates through printing plate imaging apparatus 10, first and second printing plates 24A and 24B can be transferred from transfer support surface 60 to imaging support surface 28 or from imaging support surface 28 to transfer support surface 60 when transfer support surface 60 is in the transfer position.

Figure 6:
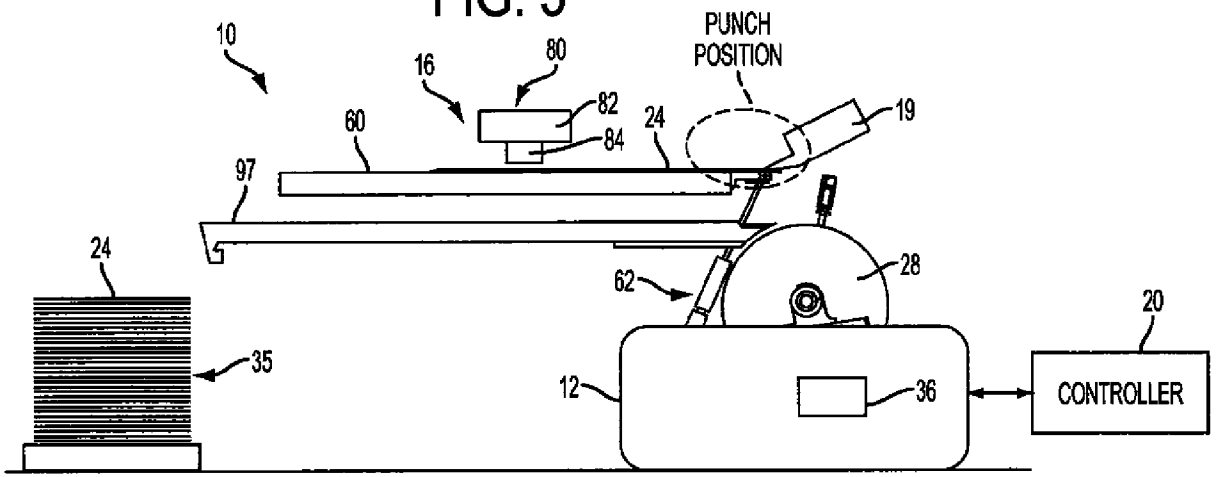
FIG. 6 shows a side view of the imaging apparatus of FIG. 3 with the transport support surface in a punch position.

When transfer support surface 60 is in the second position, alignment edges 52 and 54 of first and second printing plates 24A and 24B are positioned proximate to a punch area 70 (not illustrated in FIG. 6). In this example embodiment, punch area 70 comprises punch drivers 72, each associated with at least one punch 73, controlled by signals from controller 20. Punches 73 are arranged to punch holes or detents or other forms in first and second printing plates 24A and 24B that can be used to locate first and second printing plates 24A and 24B in the printing presses into which they will be installed. While it is common in the industry for punches 73 to be used to form such alignment features and for printing presses to use punch formed features to align printing plates, it will be appreciated that there are a variety of other ways in which punch drivers 72 can form alignment surfaces in printing plates 24. For example, in other embodiments, punch area 70 can form alignment features using punch drivers 72 that control other techniques to form the alignment features including for example and without limitation, laser cutting, thermal cutting, drilling, chemical etching, ablation, and other well known mechanical, chemical, and electrical processes.

Figure 7:
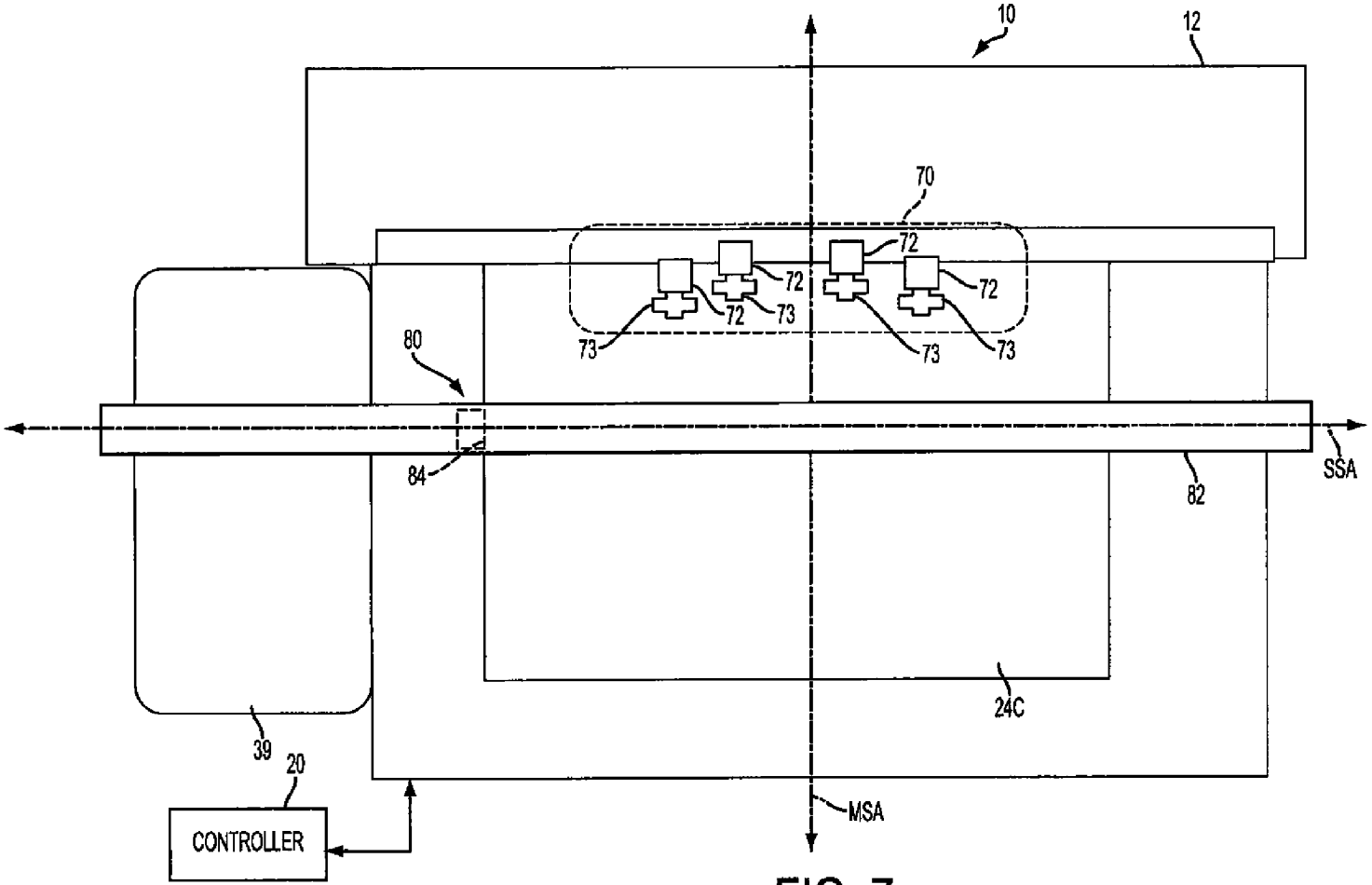
FIG. 7 shows a top view of the imaging apparatus of FIG. 1 with a single printing plate positioned on the transfer support surface.

In an example embodiment illustrated in FIG. 7, a universal punch area 70 adapted to punch a single printing plate is employed. Punch area 70 is advantageously positioned at a central position relative to the sub-scanning axis SSA so that when printing plate imaging apparatus 10 is used to form alignment features in a single large printing plate 24C, punch area 70 will be pre-positioned to form alignment features in such a large printing plate 24C without repositioning substantial portions of large printing plate 24C off of the transfer support surface 60.

However, a punch area 70 that is positioned in this advantageous location does not allow either of the first and second printing plates 24A and 24B to be moved directly into punch area 70. Accordingly, a plate positioning system 80 is provided that is operable to position each of first and second printing plates 24A and 24B along the sub-scanning axis SSA. Plate positioning system 80 comprises a positioning actuator 82 driving at least one contact surface 84 to adjust the position of first and second printing plates 24A and 24B along the sub-scanning axis SSA so that only one of first and second printing plates 24A and 24B are presented to punch area 70. The positioning actuator 82 is adapted to drive contact surface 84 to engage a surface of each of the first and second printing plates 24A and 24B to selectively position the printing plates along the sub-scanning axis SSA.

Figure 8:
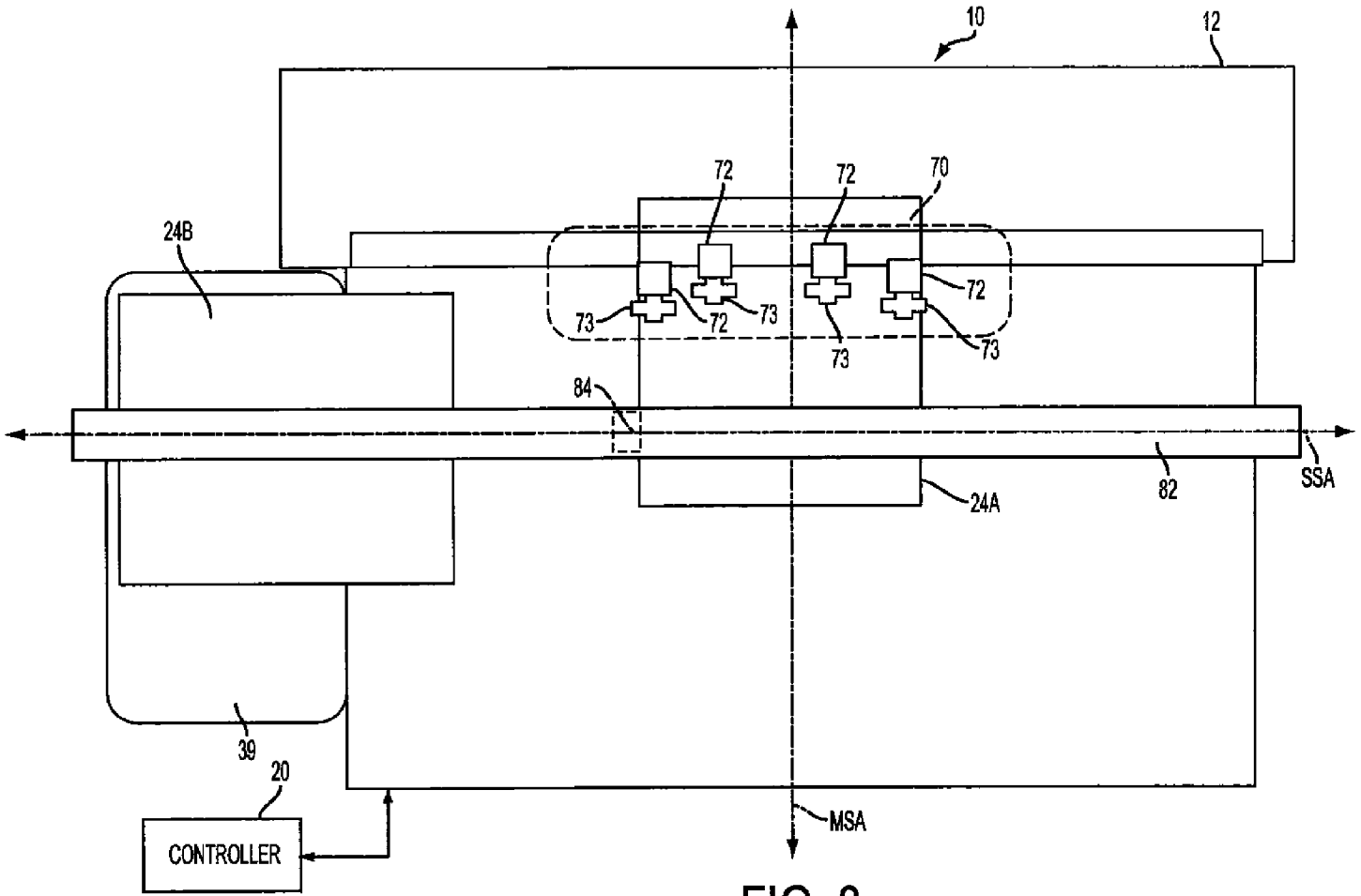
FIG. 8 shows a top view of the imaging apparatus of FIG. 1 with a plurality of printing plates positioned on the transfer support surface.

As illustrated in FIG. 8, first printing plate 24A has been appropriately positioned within punch area 70 while second printing plate 24B has been moved to storage area 39. The use of a universal punch area 70 reduces the complexity and positional conflicts that would be associated with a plurality of punch areas that would each need to be adaptable for a plurality of printing plates. Various methods for operating similar punching systems are described in WO 2007/117477, which is herein incorporated by reference.

It will be appreciated that in the illustration of FIGS. 7 and 8, a punch area 70 is shown having a fixed arrangement of punch drivers 72 and punches 73. However, these punch drivers 72 and punches 73 can be selectively actuated, moved, or removed to provide variable arrangements of alignment features in a printing plate 24. For example some of the punches 73 can be moved laterally along the sub-scanning axis and others can be moved along the main scanning axis. Such movements of the punches 73 can be made manually or automatically.

After first printing plate 24A is punched, positioning actuator 82 is operated to cause contact surface 84 to engage printing plate 24 to move it to a subsequent processing system (i.e. if contact surface is not already in engagement with first printing plate 24A). In this illustrated embodiment, first printing plate 24A is moved along a path aligned with the sub-scanning axis SSA. In this respect, plate positioning system 80 acts as a printing plate ejector will be referred to henceforth as plate positioning system/ejector 80. It will be appreciated that positioning actuator 82 and contact surface 84 can take any number of forms including, but not limited to, a motor that drives a screw that extends along the sub-scanning axis, and the rotation of which alters the sub-scanning axis position of a threaded nut on contact surface 84. Alternately and without limitation, positioning actuator 82 can include a motor that drives timing belts, chains, rack elements, associated pulleys, sprockets, gears, a hydraulic system, or a pneumatic system. Similarly, contact surface 84 can be adapted to act on only one of the printing plates 24 at a given time or on a plurality of printing plates 24 at the same time. Contact surface 84 can include a plurality of contact pads arranged in various configurations. The configurations of contact pads can be adapted to engage different surfaces of one or more printing plates 24. In some example embodiments of the invention, separate printing plate ejectors and printing plate positioning systems are employed.

Figure 10:
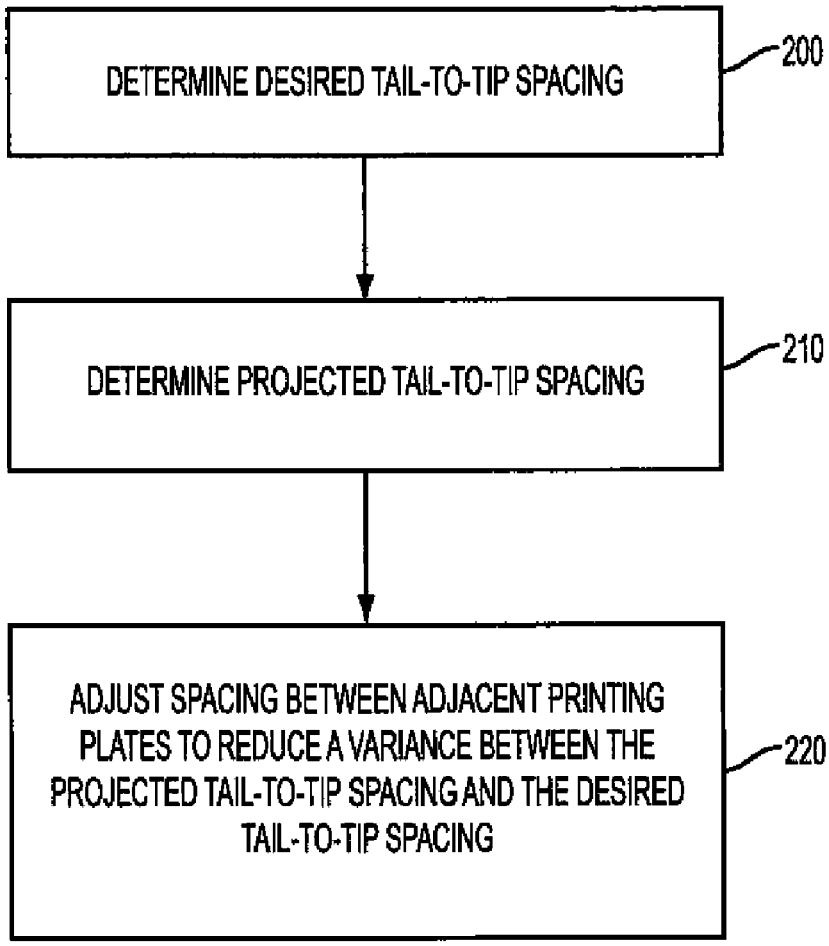
FIG. 10 shows a flow diagram representing a method practiced in accordance with an example embodiment of the invention.
Figure 11:
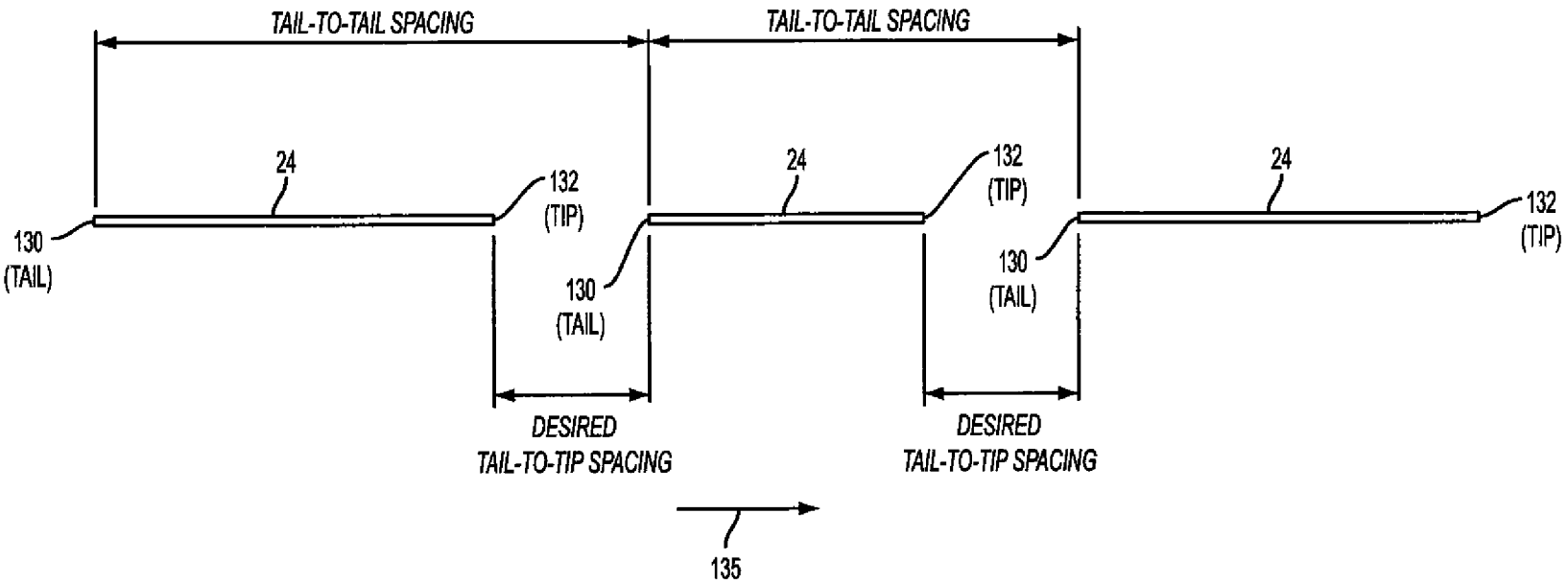
FIG. 11 shows a sequence of printing plates in which adjacent printing plates are separated from one another by a desired tail-to-tip spacing.

FIG. 10 shows a flow diagram representing a method practiced in accordance with an example embodiment of the invention. In this example embodiment, plate positioning system/ejector 80 is actively controlled to eject a sequence of printing plates 24 to reduce a variance between a projected tail-to-tip spacing between adjacent printing plates 24 in the sequence and a desired tail-to-tip spacing. FIG. 11 shows an idealized sequence of printing plates 24 wherein each of the printing plates 24 have been provided to the sequence in a manner in which adjacent printing plates 24 are separated from one another by a desired tail-to-tip spacing. Each of the adjacent printing plates 24 are separated from one another by an equal spacing despite the fact that some of the printing plates 24 are sized differently than other printing plates 24 in the sequence. Such a printing plate sequence can enhance overall printing plate making productivity. FIG. 11 shows various pairs of adjacent printing plates 24 in which a trailing edge 130 of one of the printing plates 24 of each pair is separated from the leading edge 132 of an adjacent printing plate 24 in the pair by a desired tail-to-tip spacing that is equal for all the pairs. FIG. 11 shows that the tail-to-tail spacing associated with each pair of adjacent printing plates 24 varies.

In step 200, a desired tail-to-tip spacing is determined. Information describing the determined desired tail-to-tip spacing can be provided to controller 20, or controller 20 can be programmed to determine the information itself. The choice of a desired tail-to-tip spacing can be motivated by various factors. When the printing plates 24 are ejected to a processing line, the desired tail-to-tip spacing may be based on a configuration of a system within the processing line. For example a configuration of a particular chemical developer can require a minimum tail-to-tip spacing to properly develop the printing plates 24. Plate stackers typically stack printing plates 24 by pivoting a support from a first position in which a printing plate 24 is supported by the support to a second position in which printing plate 24 is flipped onto a stack. A particular configuration of a plate stacker may require a minimum tail-to-tip spacing to avoid potential damage to a printing plate that has arrived to the first position prior to the return of the plate stacker support.

Once a desired tail-to-tip spacing has been determined, controller 20 is programmed to determine a projected tail-to-tip spacing between two adjacent printing plates 24 that are to be ejected in step 210. In some example embodiments, controller 20 is programmed to determine a projected tail-to-tip spacing between each adjacent pair of printing plates 24 in the sequence. Controller 20 is further programmed to adjust a spacing between the adjacent printing plates to reduce a variance between the projected tail-to-tip spacing and the desired tail-to-tip spacing in step 220.

Figure 9:
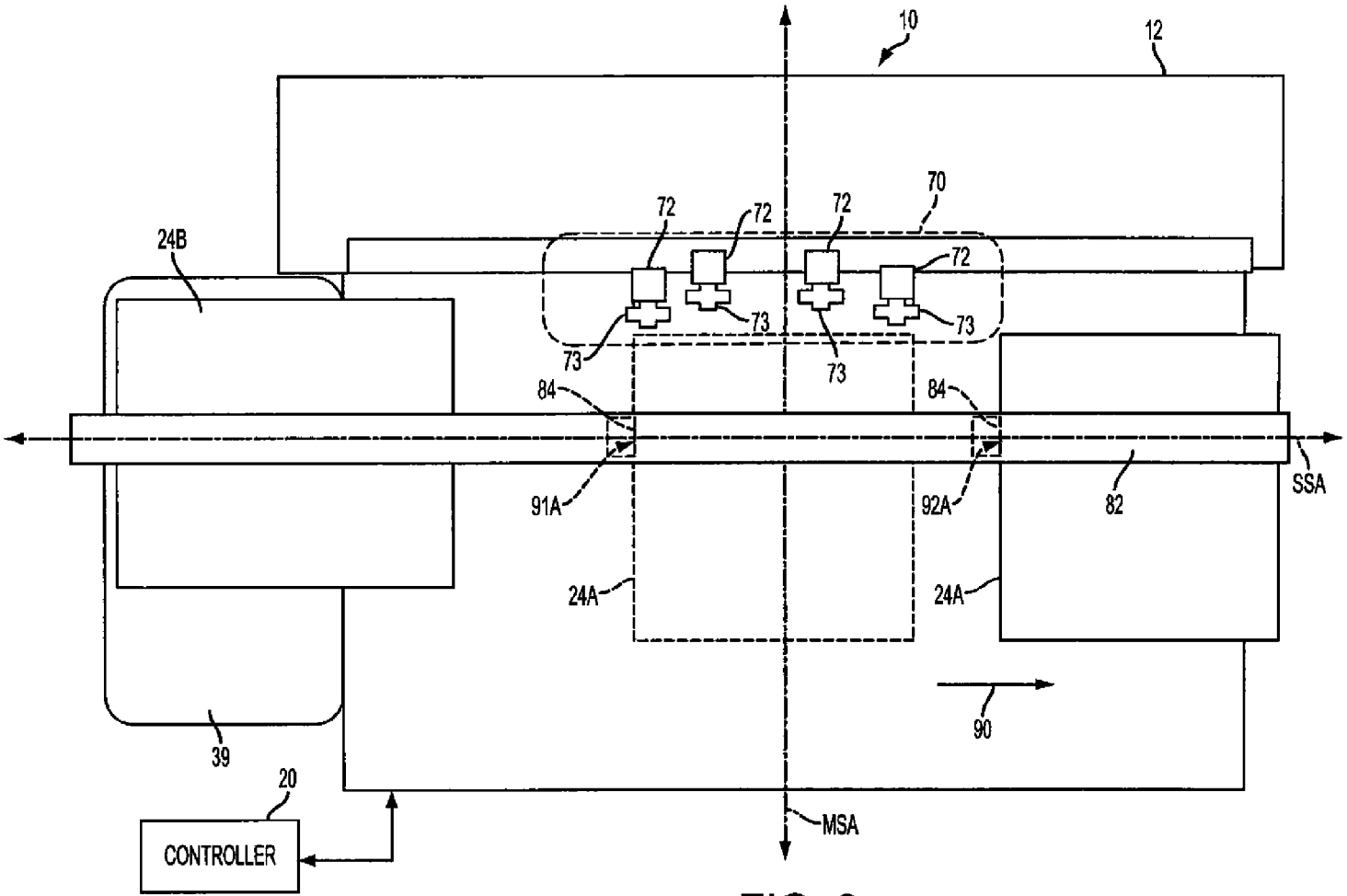
FIG. 9 shows a top view of the imaging apparatus of FIG. 1 ejecting a first printing plate.

The projected tail-to-tip spacing is determined on various factors. Some of these factors can be influenced by a particular configuration or architecture of the particular imaging system from which the sequence of printing plates 24 is ejected. In the case of printing plate imaging apparatus 10, FIG. 9 shows part of an ejection process for first and second printing plates 24A and 24B. In this example embodiment, after first printing plate 24A is moved away from punch area 70 (i.e. after a punching operation), plate positioning system/ejector 80 is operated to eject first printing plate 24A from printing plate imaging apparatus 10 along an ejection path 90. In this example embodiment, ejection path 90 is along sub-scanning axis SSA. Positioning actuator 82 causes contact surface 84 to engage with a surface of first printing plate 24A (i.e. shown in broken lines) at a first position 91A and move first printing plate 24A along ejection path 90. In this example embodiment, contact surface 84 is moved to second position 92A. Positioning actuator 82 subsequently causes contact surface 84 to disengage from first printing plate 24A at second position 92A and move back to engage second printing plate 24B. Second printing plate 24B is ejected in a similar fashion.

The availability of second printing plate 24B for ejection is one possible factor that can have a bearing on the determination of the projected tail-to-tip spacing. A duration of time required to subject second printing plate 24B to a particular operation with printing plate imaging apparatus 10 (e.g. imaging or punching) may affect its availability for ejection. A size difference between second printing plate 24B and first printing plate 24A (e.g. a size difference along a direction of ejection path 90) can effect a required distance that contact surface 84 must travel to engage second printing plate 24B as well as distance that engaged second printing plate 24B must travel to achieve the desired tail-to-tip spacing with the previously ejected first printing plate 24A. Other factors can include acceleration/deceleration parameters associated with positioning actuator 82.

Another factor is a repositioning of first printing plate 24A after it has been positioned at second position 92A. First printing plate 24A can be repositioned from second position 92A for various reasons. For example, first printing plate 24A can be ejected from printing plate imaging apparatus 10 to a system of a processing line (e.g. a buffering system, pre-bake oven, chemical developer, etc.) which repositions first printing plate 24A. The projected tail-to-tip between the first and second printing plates 24A and 24B would need to consider the repositioning of first printing plate 24A in these cases.

The configuration of a particular system within a processing line can contribute to other factors. The ejection speed of each of the first and second printing plates 24A and 24B can affect a spacing between the plates. Some processing line system configurations can restrict ejection speeds more than other system configurations. For example, if each of the first and second printing plates 24A and 24B is to be directly ejected onto a support of a system that permits substantial relative movement between each of the ejected printing plates and the support (e.g. ejecting onto movable support 126 of buffering system 118) then limits on the printing plate ejection speeds need not be imposed since there is a relatively low potential for damage to the printing plates. However, if each of the first and second printing plates 24A and 24B is to be directly ejected onto a support of a system that does not permit substantial relative movement between each of the printing plates and the support (e.g. ejecting on the meshed movable support 120 of pre-bake oven 110), then limits on the printing plate ejection speed are likely needed to be imposed along part or all of the ejection path 90. Other system configurations such as those of chemical developer 116 which includes nipped rollers can impose limits on the both or either of the ejection speed and the amount of travel that contact surface 84 or printing plate 24 undergoes along ejection path 90.

Controller 20 is programmed to determine the projected tail-to-tip spacing from these factors. Controller 20 is programmed to determine an ejection method for second printing plate 24B that best reduces variances between the projected tail-to-tip spacing and the desired tail-to-tip spacing. Accordingly, adjustments made to the spacing between ejected adjacent printing plates 24 are made on the basis of these factors. In the case of printing plate imaging apparatus 10, the various adjustments are made to the operating parameters of plate positioning system/ejector 80. For example, plate positioning system/ejector 80 can be operated to vary the ejection speed of second printing plate 24B. In some example embodiments, the ejection speed of second printing plate 24B is made different from the ejection speed of first printing plate 24A to reduce variances between the projected tail-to-tip spacing and the desired tail-to-tip spacing. In some example embodiments, the ejection speed of at least one of the printing plates 24 is made to be greater than a conveyance speed of a system in a processing line to which the printing plates 24 are ejected. In some example embodiments, an ejection speed a printing plate 24 will be limited to be similar to the conveyance speed of the processing line system at least at a position along ejection path 90 in which the printing plate 24 is received by the processing line system. Such limitations can arise from systems that have meshed conveyors or nipped roller configuration for example. In some of these example embodiments, variances between the projected tail-to-tip spacing and the desired tail-to-tip spacing can be reduced by employing higher ejection speeds along part of the ejection path 90 and decelerating these ejection speeds to levels similar to the conveyance speed of a processing line system during another part of the ejection path 90.

As previously described in various example embodiments, a printing plate 24 is ejected by operating plate positioning system/ejector 80 to engage the printing plate 24 at a first position and transport it to a second position at which point plate positioning system/ejector 80 disengages from the printing plate 24. In some example embodiments, variances between the projected tail-to-tip spacing and the desired tail-to-tip spacing can be reduced by varying the location of the second position of various ejected printing plates 24.

Conventional imaging apparatus (e.g. imaging apparatus 100) include ejection systems that travel to second positions which are substantially common regardless of variances in the sizes of the printing plates that are ejected. When these conventional imaging apparatus eject printing plates 24 to a system that includes input nipped rollers (e.g. chemical developer 116), an edge portion of each printing plate 24 is positioned such that each printing plate 24 enters the nipped rollers at a common position. However, since these conventional ejectors are controlled to disengage from the printing plates 24 at a common second position regardless of the size of the printing plates 24, they continue to travel to this second position before disengaging from the printing plates 24. This occurs despite the fact that the engaged nip rollers are capable of conveying the printing plates 24 without the assistance of the conventional ejectors. These conventional techniques consume valuable time that could be used to reduce variances between a projected tail-to-tip spacing and a desired tail-to-tip spacing.

In various example embodiments of the invention, the location of a position in which an ejector disengages from a given printing plate 24 is determined based on a size of the printing plate 24. In one example embodiment, the location of the disengagement position can be determined based at least on the size of the printing plate 24 along a direction of movement of the printing plate 24. In some example embodiments, the location of the disengagement position can be determined based at least on the size of the printing plate 24 along a direction of path traveled by a sequence of printing plates that includes the printing plate 24. In some example embodiments, the location of the disengagement position can be determined based at least on the size of the printing plate 24 along a direction of ejection path 90. In some example embodiments, the location of the disengagement position can be determined based at least on the size of the printing plate 24 along a direction of a path traveled by contact surface 84.

Figure 12A:
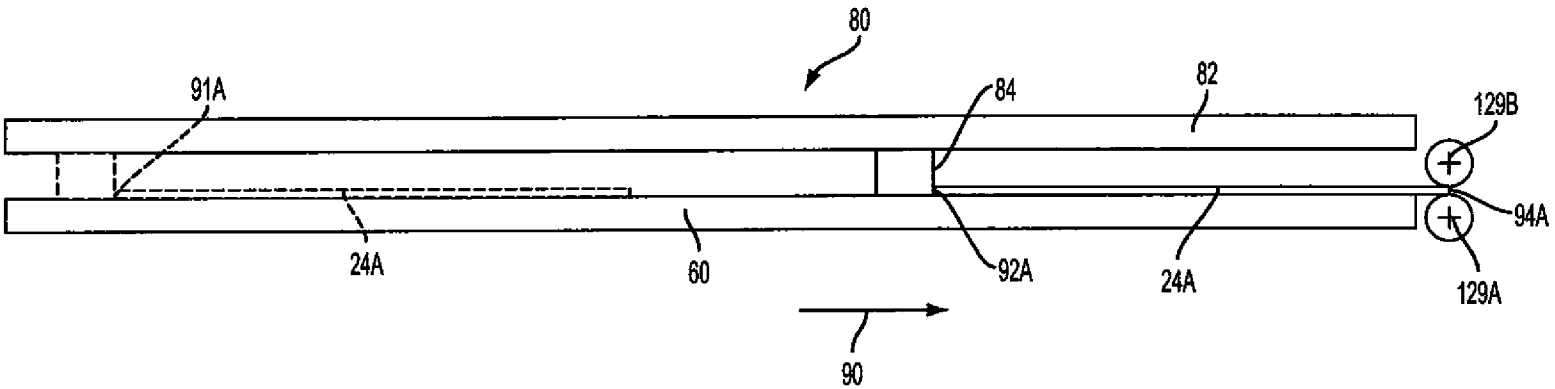
FIGS. 12A and 12B shows a side views of a plate positioning system/ejector of the imaging apparatus of FIG. 1 ejecting different sized printing plates according to an embodiment of the invention.

FIG. 12A shows a side view of plate positioning system/ejector 80 ejecting first printing plate 24A. FIG. 12A shows that contact surface 84 is moved from first position 91A to second position 92A to transport first print plate 24A. First printing plate 24A is shown in broken lines at first position 91A. When contact surface 84 is positioned at the second position 92A, an edge portion 94A of the first printing plate 24A is engaged by the nip roller 129B and support roller 129A. Unlike conventional techniques, contact surface 84 does not continue to engage first printing plate 24A as the printing plate is moved further into the processing line. Rather, contact surface 84 disengages from first printing plate 24A at second position 92A and can be employed for a next task (e.g. positioning second printing plate 24B for punching). This sequence can accordingly enhance overall throughput of the plate-making process. Contact surface 84 can disengage from first printing plate 24A at second position 92A by moving one or both of contact surface 84 and first printing plate 24A.

Figure 12B:
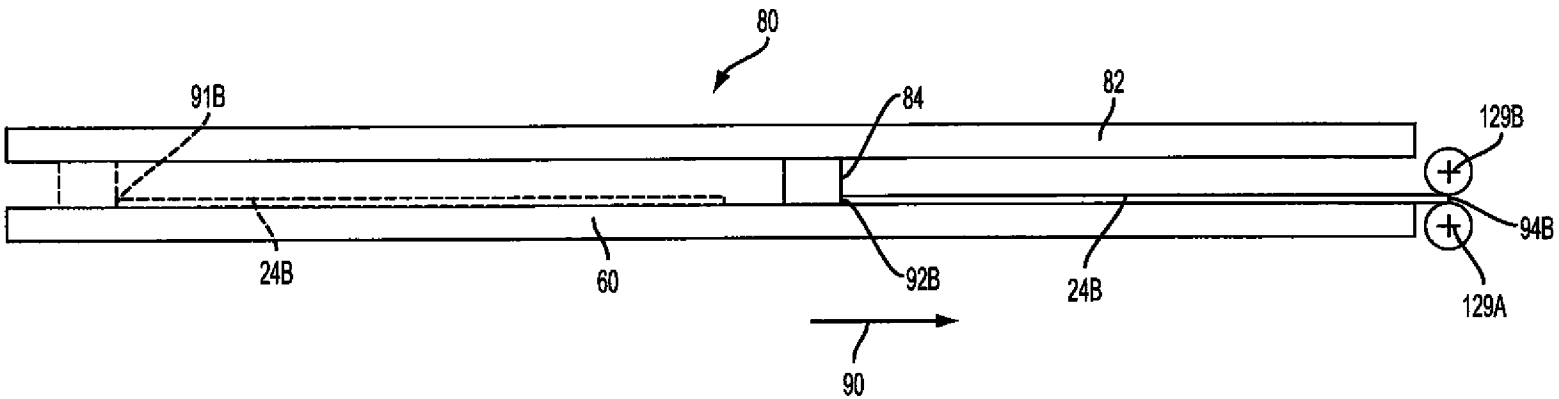

Different disengagement positions can be associated with different sized printing plates 24. In comparison with FIG. 12A, FIG. 12B shows the ejection of the larger second printing plate 24B. FIG. 12B shows that contact surface 84 is positioned from a first position 91B to a third position 92B. Second printing plate 24B is also shown in broken lines at first position 91B. Although first position 91B is shown to be substantially in the same location as first position 91A in the illustrated embodiment, other example embodiments can employ different locations. Third position 92B is however located in a different location than second position 92A. In fashion similar to that shown in FIG. 12A, third position 92B is selected to cause an edge portion 94B to be located at the nip roller 129B and support roller 129A. However, since second printing plate 24B is differently sized than first printing plate 24A, the location of third position 92B will differ. In this example embodiment, edge portions 94A and 94B are located at the same locations.

Figure 13:
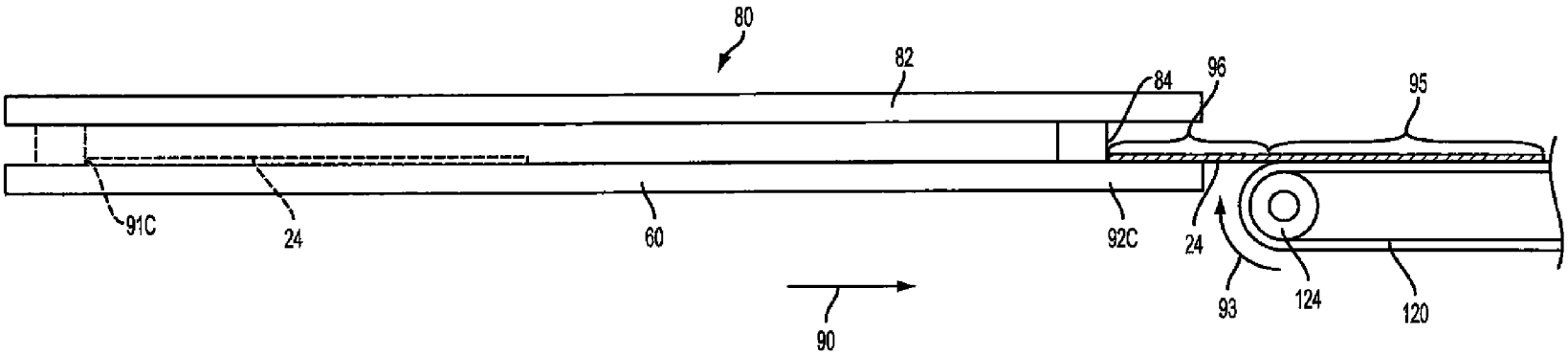
FIG. 13 shows show a side view of a plate positioning system/ejector of the imaging apparatus of FIG. 1 ejecting a printing plate according to another example embodiment of the invention.

In some example embodiments, the location of a second position at which contact surface 84 disengages from a printing plate 24 can be selected on the basis of other criteria. For example, FIG. 13 shows a view of plate positioning system/ejector 80 engaging a printing plate 24 (shown in broken lines) at a first position 91C on a first support surface (i.e. transfer support surface 60) and moving the printing plate 24 along ejection path 90. In this illustrated embodiment, printing plate 24 is ejected to a processing line system that includes a second movable support surface. In this embodiment, the second movable support surface is the meshed movable support 120 of pre-bake oven 110. Meshed movable support 120 is shown moving under the influence of sprocket 124 which is shown rotating as per arrow 93.

Since meshed movable support 120 requires ejection speed restrictions to reduce potential damage to printing plate 24, improved throughput is achieved by reducing the distance traveled by contact surface 84 as it transports printing plate 24 at these restricted speeds. In this example embodiment, plate positioning system/ejector 80 is operated to move contact surface 84 to a second position 92C to cause a portion 95 of printing plate 24 to be supported by meshed movable support 120. In this example embodiment, the location of second position 92C is selected to cause an extent of portion 95 to be sufficiently sized to increase a frictional force between the printing plate 24 and meshed moveable support 120 to a level sufficient to cause meshed movable support 120 to move a remaining additional portion 96 of printing plate 24 onto the meshed movable support 120.

In various embodiments of the invention, an extent of the portion 95 that is required to be supported on the meshed movable support 120 is determined based on various factors which can include without limitation, the frictional characteristics of the meshed movable support 120, the frictional characteristics of the supported surface of printing plate 24, and the presence of burrs on various edges of printing plate 24. In various example embodiment of the invention, an extent of portion 95 is determined based at least on a size of printing plate 24. In some embodiments, the extent of portion 95 is determined based at least on an overall size of the printing plate 24 along a direction of movement of the printing plate 24. For example, the direction of movement can be a direction of movement along ejection path 90 or a direction of movement along a path traveled by meshed movable support 120. The extent of portion 95 is selected to create sufficient frictional force with meshed movable support 120 to exceed the frictional forces created between transfer support surface 60 and various other portions of printing plate 24 to thereby draw the remainder of printing plate 24 onto meshed movable support 120 without further assistance from plate positioning system/ejector 80. Contact surface 84 is therefore allowed to disengage from printing plate 24 at an earlier time in the process to enhance productivity. For example, contact surface 84 can be operated to move away from second position 92C to engage a second printing plate 24 (not shown) positioned on transfer support surface 60 while meshed movable support 120 moves additional portion 96 onto itself.

The required extent of portion 95 can be determined in various ways including by controlled testing. Plate positioning system/ejector system 80 can be operated to move a printing plate 24 having a particular size or manufacture to a position in which an extent of the portion 95 along a direction of movement of the printing plate 24 is sufficient to cause the meshed movable support 120 to move the printing plate 24. In some controlled tests, plate positioning system/ejector 80 moves printing plate 24 sufficiently to establish contact between a surface of printing plate 24 and meshed movable support 120. Relative movement or slippage along a direction tangential to the contacted surface will indicate that sufficient frictional force is not present. Plate positioning system/ejector 80 continues to move printing plate 24 onto meshed movable support 120 to reduce the amount of relative movement to a point sufficient to draw the remainder of the printing plate 24 onto meshed movable support 120 without the assistance of plate positioning system/ejector 80.

In some example embodiments an extent of portion 95 can be determined based at least on an algorithm that multiplies the overall size of printing plate 24 (i.e. along a direction of ejection path 90 or along a direction of a path of movement of meshed movable support 120) by a fractional multiplier. It has been determined that fractional multipliers within a range of 0.5 to 0.8 are sufficient for most aluminum printing plates 24 interacting with meshed movable supports 120 comprising steel meshes. It is understood, however, that different fractional multipliers can apply to movable support surfaces that differ from meshed movable support 120. In some example embodiments, an extent of portion 95 will be selected to be within a range of 50% to 80% of the overall size of printing plate 24.

The term "actuator" has been used in the present disclosure to generically describe any form of automation that can convert or use energy to cause one structure to move relative to a reference point. These structures can include without limitation motors, or any known suitable engine of any type, and the term actuator is deemed to be inclusive of any known mechanical structures capable of converting energy provided in a form useful in the manner described herein including, but not limited to, any known form of mechanical or electromechanical transmission.

The term "contact surface" has been used in the present disclosure to generically describe any form of surface adaptable for engaging a printing plate 24. Engagement can include the establishment of contact between the contact surface and the printing plate 24. Engagement can include the formation of a connection between the contact surface and the printing plate 24. Contact surface can include without limitation, various members adapted to engage one or more surfaces of printing plates 24 for the purpose of moving the printing plates 24. The members can include various geometries and/or materials adapted to reduce potential damage to a printing plate 24. The contact surfaces can include various features adapted to reduce potential damage to an image modifiable surface of a printing plate 24. The contact surfaces can include various features adapted to reduce potential contact stress damage to an edge surface of a printing plate 24. Without limitation, contact surfaces can include a member to adapted to engage and secure a printing plate 24. For example, contact surfaces can include various members adapted to engage and secure various printing plates 24 by the application of suction or other forms of securement techniques.

The invention has been described in detail with particular reference to certain preferred embodiments thereof, but it will be understood that variations and modifications can be effected within the scope of the invention.

PARTS LIST

10 printing plate imaging apparatus
12 frame
14 image recording system
16 transfer assembly
17 plate exchange surface
19 alignment surface punch system
20 controller
22 imaging head
24 printing plates
24A first printing plate
24B second printing plate
24C large printing plate
28 imaging support surface
30 light emission channel source
32 light emission channel source
33 plate handling mechanism
34 exterior surface
35 printing plate stack
36 motor
38 threaded screw
39 storage area
40 first imaging alignment surface
42 first imaging alignment surface
44 second imaging alignment surface
46 second imaging alignment surface
52 alignment edge of first printing plate
54 alignment edge of second printing plate
60 transfer support surface
62 positioning system
70 punch area
72 punch drivers
73 punch
80 plate positioning system/ejector
82 positioning actuator
84 contact surface
90 ejection path
91A first position
91B first position
91C first position
92A second position
92B third position
92C second position
93 arrow
94A edge portion
94B edge portion
95 portion
96 additional portion
97 load table
100 imaging apparatus
102A processing line
102B processing line
102C processing line
110 pre-bake oven
112 chemical developer
114 post-bake oven
115 plate stacker system
116 chemical developer
118 buffering system
120 (meshed) movable support
122 meshed material
124 sprocket
126 movable support
127 belts
128 drive pulley
129A support roller
129B nip roller
130 printing plate trailing edge (tail)
132 printing plate leading edge (tip)
135 path
200 determine desired tail-to-tip spacing step
210 determine projected tail-to-tip spacing step
220 adjust spacing between adjacent printing plate step
MSA main scanning axis
SSA sub-scanning axis

The invention claimed is:

1. A method for ejecting printing plates from an imaging apparatus, comprising:

providing a plurality of the printing plates to the imaging apparatus;

forming an image on at least one of the printing plates;

providing a controller;

wherein the controller determines a desired tail-to-tip spacing and a projected tip-to-tail spacing between a trailing edge of one plate and a leading edge of another plate between adjacent printing plates;

wherein the controller controls ejecting a sequence of the printing plates from the imaging apparatus along a path; and adjusting a spacing between two adjacent printing plates in the sequence of the printing plates to reduce a variance between the projected tail-to-tip spacing and the desired tail-to-tip spacing.

2. A method according to claim 1, wherein the two adjacent printing plates in the sequence of the printing plates comprise different sizes, and the adjustment step is performed based at least on a difference between the sizes of the two adjacent printing plates.

3. A method according to claim 1, wherein the two adjacent printing plates in the sequence of the printing plates comprise different sizes, and the projected tail-to-tip spacing is determined based at least on a difference between the sizes of the two adjacent printing plates.

4. A method according to claim 1, wherein the two adjacent printing plates in the sequence of the printing plates comprise different sizes along a direction of the sequence of the printing plates, and the adjustment step is performed based at least on a difference between the sizes of the two adjacent printing plates.

5. A method according to claim 1, wherein the imaging apparatus comprises a support surface and the method comprises positioning each of the two adjacent printing plates on the support surface and sequentially ejecting each printing plate of the two adjacent printing plates from the support surface along the path.

6. A method according to claim 5, wherein the adjustment step is performed based at least on a spacing between the two adjacent printing plates positioned on the support surface.

7. A method according to claim 5, wherein the imaging apparatus comprises an ejector adapted to separately engage an edge surface of each of the two adjacent printing plates and wherein the adjustment step is performed based at least on a spacing between edge surfaces of the two adjacent printing plates positioned on the support surface.

8. A method according to claim 1, wherein the spacing between the two adjacent printing plates is adjusted by at least varying an ejection speed of at least one printing plate of the two adjacent printing plates.

9. A method according to claim 1, wherein the imaging apparatus comprises an ejector adapted to separately engage a surface of each of the two adjacent printing plates, and the spacing between the two adjacent printing plates is adjusted by at least operating the ejector to disengage from each printing plate of the two adjacent printing plates at a different location.

10. A method according to claim 1, comprising ejecting the sequence of the printing plates to a processing line comprising a plurality of systems, wherein the adjustment step is performed based at least on a configuration of a system of the processing line.

11. A method according to claim 10, wherein the system comprises a support surface adapted to support and move each printing plate of the sequence of the printing plates, and wherein the configuration of the system includes a surface characteristic of the support surface.

12. A method according to claim 10, wherein the system comprises a support surface adapted to support and convey each printing plate of the sequence of the printing plates, and wherein the configuration of the system includes a conveyance speed associated with the support surface.

13. A method according to claim 10, wherein the system of the processing line is adapted to receive the sequence of the printing plates ejected from the imaging apparatus prior to any of the other systems of the processing line.

14. A method according to claim 1, comprising ejecting the sequence of the printing plates to a processing line comprising a plurality of systems, wherein the desired tail-to-tip spacing is determined based at least on a configuration of one of the systems of the processing line.

15. A method for handling printing plates, comprising:

providing a plurality of the printing plates to an imaging apparatus;

forming an image on at least one of the printing plates within the imaging apparatus;

providing a controller wherein the controller determines a desired tail-to-tip spacing between a trailing edge of one plate and a leading edge of another plate between adjacent printing plates;

wherein the controller controls ejecting a sequence of the printing plates from the imaging apparatus along a path; and wherein the controller adjusts ejection speed of a printing plate in the sequence of the printing plates from an ejection speed of another printing plate in the sequence of the printing plates to cause a spacing between the printing plate and an adjacent printing plate in the sequence of the printing plates to substantially equal the desired tail-to-tip spacing.

16. A method according to claim 15, wherein the printing plate has a different size than the adjacent printing plate.

17. A method according to claim 15, wherein the printing plate has a different size along a direction of the path than the adjacent printing plate.

18. A method according to claim 15, wherein the spacing between the printing plate and the adjacent printing plate is a tail-to-tip spacing.

19. A method according to claim 15, comprising ejecting the sequence of the printing plates to a processing line that includes a system adapted to convey each printing plate of the sequence of the printing plates with a conveyance speed, and wherein each printing plate in the sequence of the printing plates is ejected from the imaging apparatus with a speed that does not exceed the conveyance speed.

20. A method according to claim 15, comprising ejecting the sequence of the printing plates to a processing line that includes a system adapted to convey each printing plate of the sequence of the printing plates with a conveyance speed, and wherein each printing plate in the sequence of the printing plates is ejected from the imaging apparatus with a speed that exceeds the conveyance speed.

21. A method according to claim 15, comprising ejecting the sequence of the printing plates to a processing line comprising a plurality of systems, wherein the desired tail-to-tip spacing is determined based at least on a configuration of one of the systems in the processing line.

22. A method for handling printing plates, comprising:

providing a plurality of the printing plates to an imaging apparatus;

forming an image on at least one of the printing plates within the imaging apparatus;

providing a controller wherein the controller determines a desired tail-to-tip spacing between a trailing edge of one plate and a leading edge of another plate between adjacent printing plates; and wherein the controller controls ejecting a sequence of the printing plates from the imaging apparatus;

operating the ejector to engage each of the printing plates in the sequence of the printing plates and move each of the printing plates in the sequence of the printing plates along a path; and disengaging the ejector from a printing plate in the sequence of the printing plates at a different location than from another printing plate in the sequence of the printing plates to cause a spacing between the printing plate and an adjacent printing plate in the sequence of the printing plates to substantially equal the desired tail-to-tip spacing.

23. A method according to claim 22, wherein the spacing between the printing plate and the adjacent printing plate is a tail-to-tip spacing.

24. A method according to claim 22, comprising ejecting the sequence of the printing plates to a processing line comprising a plurality of systems, wherein the desired tail-to-tip spacing is determined based at least on a configuration of one of the systems in the processing line.

* * * * *